US008005677B2

(12) United States Patent
Cutaia

(10) Patent No.: US 8,005,677 B2
(45) Date of Patent: Aug. 23, 2011

(54) SOURCE-DEPENDENT TEXT-TO-SPEECH SYSTEM

(75) Inventor: Nicholas J. Cutaia, Brighton, MA (US)

(73) Assignee: Cisco Technology, Inc., San Jose, CA (US)

( * ) Notice: Subject to any disclaimer, the term of this patent is extended or adjusted under 35 U.S.C. 154(b) by 1245 days.

(21) Appl. No.: 10/434,683

(22) Filed: May 9, 2003

(65) Prior Publication Data

US 2004/0225501 A1 Nov. 11, 2004

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | | |
|---|---|---|---|---|
| 5,704,007 | A * | 12/1997 | Cecys | 704/260 |
| 5,913,193 | A * | 6/1999 | Huang et al. | 704/258 |
| 5,915,237 | A * | 6/1999 | Boss et al. | 704/270.1 |
| 6,289,085 | B1 | 9/2001 | Miyashita et al. | 379/88.02 |
| 6,424,946 | B1 | 7/2002 | Tritschler et al. | 704/272 |
| 6,539,354 | B1 * | 3/2003 | Sutton et al. | 704/260 |
| 6,651,042 | B1 * | 11/2003 | Field et al. | 704/270 |
| 6,813,604 | B1 * | 11/2004 | Shih et al. | 704/260 |
| 6,873,952 | B1 * | 3/2005 | Bailey et al. | 704/251 |
| 6,970,820 | B2 * | 11/2005 | Junqua et al. | 704/258 |
| 7,177,801 | B2 * | 2/2007 | Krasnanski et al. | 704/201 |
| 7,200,560 | B2 * | 4/2007 | Philbert | 704/271 |
| 2001/0056348 | A1 | 12/2001 | Hyde-Thomson et al. | 704/260 |
| 2002/0103648 | A1 | 8/2002 | Case et al. | 704/260 |
| 2002/0143542 | A1 | 10/2002 | Eide | 704/260 |
| 2002/0169610 | A1 | 11/2002 | Luegger | 704/260 |
| 2002/0193994 | A1 | 12/2002 | Kibre et al. | 704/260 |

FOREIGN PATENT DOCUMENTS

| | | | |
|---|---|---|---|
| GB | 2 364 850 | A | 2/2002 |
| JP | 61028128 | | 2/1986 |
| JP | 07319495 | | 12/1995 |
| JP | 2000148189 | | 5/2000 |
| WO | WO 02/11016 | A2 | 2/2002 |
| WO | WO 02/49003 | A1 | 6/2002 |
| WO | WO 02/090915 | A1 | 11/2002 |

OTHER PUBLICATIONS

Kain et al. Spectral Voice Conversion for Text-To-Speech Synthesis, May 12-15, 1998, Proceedings of the 1998 IEEE International Conference on Acoustics, Speech, and Signal Processing, pp. 285-288.*
English Translation of Juan Dafcik et al. WO 02/49003 "Method and System for Converting Text to Speech", translated Aug. 29, 2007 by Martha Witebsky, Translations Branch, USPTO.*

(Continued)

*Primary Examiner* — Michael N Opsasnick
(74) *Attorney, Agent, or Firm* — Baker Botts L.L.P.

(57) ABSTRACT

A method of generating speech from text messages includes determining a speech feature vector for a voice associated with a source of a text message, and comparing the speech feature vector to speaker models. The method also includes selecting one of the speaker models as a preferred match for the voice based on the comparison, and generating speech from the text message based on the selected speaker model.

34 Claims, 4 Drawing Sheets

OTHER PUBLICATIONS

Notification of Transmittal of the International Search Report and the Written Opinion of the International Searching Authority for International application No. PCT/US04/13366, filed Apr. 28, 2004, (10 pages), Mar. 14, 2006.

Reynolds et al., Robust Text-Independent Speaker Identification Using Gaussian Mixture Speaker Models, *IEEE Transactions on Speech and Audio Processing*, vol. 3, No. 1, Jan. 1995, pp. 72-83.

Reynolds et al., "Speaker Verification Using Adapted Gaussian Mixture Models," *Digital Signal Processing Review Journal*, vol. 10, 2000, 21 pages.

"Speech Processing, Transmission and Quality aspects (STQ); Distributed Speech Recognition; Front-end feature extraction algorithm; Compression algorithms" ETSI ES 201108 V1.1.2 (Apr. 2000) ETSI Standard, *European Telecommunications Standards Institute*, Oct. 30, 2002, 20 pages.

Speech Synthesis Markup Language Version 1.0—W3C Working Draft, *W3C*, Dec. 2, 2002, 38 pages.

Burger et al., "Requirements for Distributed Control of ASR, SI/SV and TTS Resources," Internet Draft, *The Internet Society*, Dec. 6, 2002, 19 pages.

Shanmugham et al., "MRCP: Media Resource Control Protocol," Internet Engineering Task Force Internet Draft, *The Internet Society*, Jan. 24, 2003, 76 pages.

European Search Report under Article 157(2)(a) EPC regarding Application No. 04750993.0-2218 (PCT/US2004013366), Dec. 12, 2006.

Pizzey's, Australia, "Examiner's first report on patent application No. 2004238228;" reply to the request for examination; Reference No. 18493CIS/MRR:kj, 2 pages, Jan. 6, 2009.

Canadian Intellectual Property Office Examination Report; Application No. 2,521,440; Title: Source-Dependent Text-to-Speech System, Apr. 17, 2009.

First Office Action issued by the State Intellectual Property Office of the People's Republic of China; Filing No. 200480010899.X; Title of Invention: Source-Dependent Text-to-Speech System, Apr. 10, 2009.

The Second Office Action issued by The Patent Office of the People's Republic of China; Application No. 200480010899.X, Date of Issue, Sep. 25, 2009.

Office Action issued by the Canadian Intellectual Property Office; Application No. 2,521,440; Owner: Cisco Technology, Inc.; Title: Source-Dependent Text-to-Speech System, Mar. 24, 2010.

Office Action issued by the Canadian Intellectual Property Office; Application No. 2,521,440; Owner: Cisco Technology, Inc.; Title: Source-Dependent Text-to-Speech System Apr. 11, 2011.

* cited by examiner

SOURCE-DEPENDENT TEXT-TO-SPEECH SYSTEM

TECHNICAL FIELD OF THE INVENTION

This invention relates in general to text-to-speech systems, and more particularly to a source-dependent text-to-speech system.

BACKGROUND OF THE INVENTION

Text-to-speech (TTS) systems provide versatility in telecommunications networks. TTS systems produce audible speech from text messages, such as email, instant messages, or other suitable text. One drawback of TTS systems is that the voice produced by the TTS system is often generic and not associated with the particular source providing the message. For example, a text-to-speech system may produce a male voice no matter who the person sending the message is, making it difficult to tell whether a particular message came from a man or a woman.

SUMMARY OF THE INVENTION

In accordance with the present invention, a text-to-speech system provides a source-dependent rendering of text messages in a voice similar to the person providing the message. This increases the ability of a user of TTS systems to determine the source of a text message by associating the message with the sound of a particular voice. In particular, certain embodiments of the present invention provide a source-dependent TTS system.

In accordance with one embodiment of the present invention, a method of generating speech from text messages includes determining a speech feature vector for a voice associated with a source of a text message, and comparing the speech feature vector to speaker models. The method also includes selecting one of the speaker models as a preferred match for the voice based on the comparison, and generating speech from the text message based on the selected speaker model.

In accordance with another embodiment of the present invention, a voice match server includes an interface and a processor. The interface receives a speech feature vector for a voice associated with a source of a text message. The processor compares the speech feature vector to speaker models, and selects one of the speaker models as a preferred match to the voice based on the comparison. The interface communicates a command to a text-to-speech server instructing the text-to-speech server to generate speech from the text message based on the selected speaker model.

In accordance with another embodiment of the present invention, an endpoint includes a first interface, a second interface, and a processor. The first interface receives a text message from a source. The processor determines a speech feature vector for a voice associated with a source of the text message, compares the speech feature vector to speaker models, selects one of the speaker models as a preferred match to the voice based on the comparison, and generates speech from the text message based on the selected speaker model. The second interface outputs the generated speech to a user.

Important technical advantages of certain embodiments of the present invention include reproduced speech with greater fidelity to the speech of the original person providing the message. This provides users of the TTS system the secondary cues that improve the user's ability to recognize the source of a message, and also provide greater comfort and flexibility in the TTS interface. This increases the desirability and usefulness of TTS systems.

Other important technical advantages of certain embodiments of the present invention include interoperability of TTS systems. In certain embodiments, the TTS system may receive information from another TTS system that might not use the same TTS markup parameters and speech generation methods. However, the TTS system can still receive speech information from the remote TTS system even though the systems do not share TTS markup parameters and speech generation methods. This allows the features of such embodiments to be adapted to operate with other TTS systems that do not include the same features.

Other technical advantages of the present invention will be readily apparent to one skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
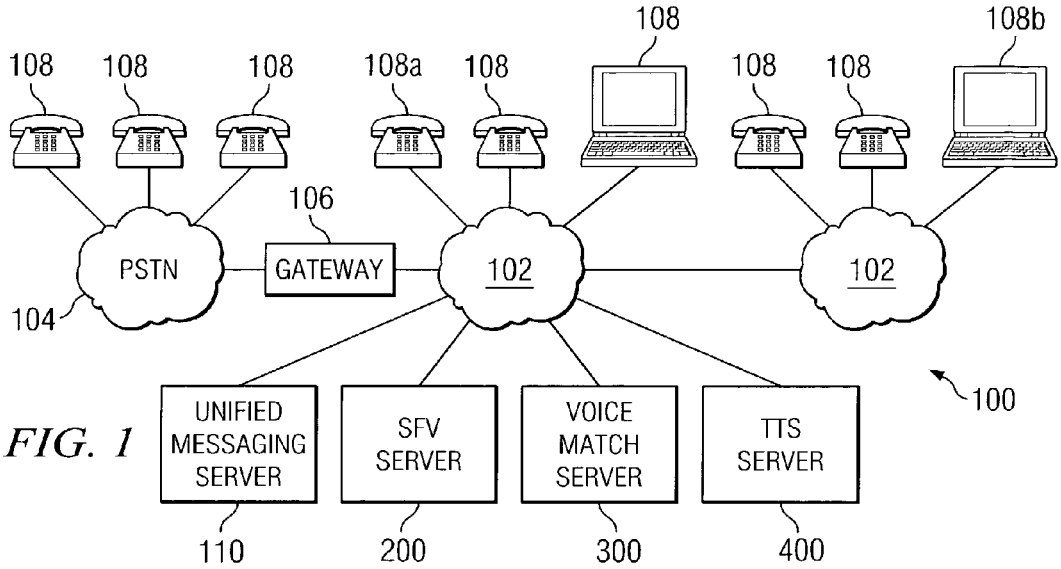
FIG. 1 is a telecommunication system, according to a particular embodiment of the present invention, that provides source-dependent text-to-speech.

FIG. 1 shows a telecommunications network 100 that allows endpoints 108 to exchange information with one another in the form of text and/or voice messages. In general, components of network 100 embody techniques for generating voice messages from text messages such that the acoustic characteristics of the voice message correspond to the acoustic characteristics of a voice associated with a source of the text message. In the depicted embodiment, network 100 includes data networks 102 coupled to the public switched telephone network (PSTN) 104 by a gateway 106. Endpoints 108 coupled to networks 102 and 104 provide communication services to users. Various servers in network 100 provide services to endpoints 108. In particular, network 100 includes a speech feature vector (SFV) server 200, a voice match server 300, a text-to-speech (TTS) server 400, and a unified messaging server 110. In alternative embodiments, the functions and services provided by various components may be aggregated within or distributed among different or additional components, including examples such as integrating servers 200, 300, and 400 into a single server or providing a distributed architecture in which endpoints 108 perform the described functions of servers 200, 300, and 400.

Overall, network 100 employs various pattern recognition techniques to determine a preferred match between a voice associated with a source of a text message and one of several different voices that can be produced by a TTS system. In general, pattern recognition aims to classify data generated from a source based either on a priori knowledge or on statistical information extracted from the pattern of the source data. The patterns to be classified are usually groups of measurements or observations, defining points in an appropriate multi-dimensional space. A pattern recognition system generally includes a sensor that gathers observations, a feature extraction mechanism that computes numeric or symbolic information from the observations, a classification scheme that classifies observations, and a description scheme that describes observations in terms of the extracted features. The classification and description schemes may be based on available patterns that have already been classified or described, often using a statistical, syntactic, or neural analysis method. A statistical method is based on statistical characteristics of patterns generated by a probabilistic system; a syntactic method is based on structural interrelationship of features; and a neural method employs the neural computing program used in neural networks.

Network 100 applies pattern recognition techniques to voice by computing speech feature vectors. As used in the following description, "speech feature vector" refers to any of a number of mathematical quantities that describe speech. Initially, network 100 computes speech feature vectors for a range of voices that may be generated by a TTS system, and associates the speech feature vectors for each voice with settings of the TTS system used the generate the voice. In the following description, such settings of the TTS system are referred to as "TTS markup parameters." Once the voices of the TTS system are learned, network 100 uses pattern recognition to compare new voices to stored voices. The comparison between voices may involve a basic comparison of numerical values or may involve more complex techniques, such as hypothesis-testing, in which the voice recognition system uses any of several techniques to identify potential matches for a voice under consideration and computes a probability score that the voices match. Furthermore, optimization techniques, such as gradient descent or conjugate gradient descent, may be used to select candidates. Using such comparison techniques, a voice recognition system can determine a preferred match among stored voices to a new voice, and in turn may associate the new voice with a set of TTS markup parameters. The following description describes embodiments of these and similar techniques and the manner in which components of the depicted embodiment of network 100 may perform these functions.

In the depicted embodiment of network 100, networks 102 represent any hardware and/or software for communicating voice and/or data information among components in the form of packets, frames, cells, segments, or other portions of data (generally referred to as "packets"). Network 102 may include any combination of routers, switches, hubs, gateways, links, and other suitable hardware and/or software components. Network 102 may use any suitable protocol or medium for carrying information, including Internet protocol (IP), asynchronous transfer mode (ATM), synchronous optical network (SONET), Ethernet, or any other suitable communication medium or protocol.

Gateway 106 couples networks 102 to PSTN 104. In general, gateway 106 represents any component for converting information communicated one format suitable for network 102 to another format suitable for communication in any other type of network. For example, gateway 106 may convert packetized information from data network 102 into analog signals communicated on PSTN 104.

Endpoints 108 represent any hardware and/or software for receiving information from users in any suitable form, communicating such information to other components of network 100, and presenting information received from other components network 100 to its user. Endpoints 108 may include telephones, IP phones, personal computers, voice software, displays, microphones, speakers, or any other suitable form of information exchange. In particular embodiments, endpoints 108 may include processing capability and/or memory for performing additional tasks relating to the communication of information.

SFV server 200 represents any component, including hardware and/or software, that analyzes a speech signal and computes an acoustical characterization of a series of time segments of the speech, a type of speech feature vector. SFV server 200 may receive speech in any suitable form, including analog signals, direct speech input from a microphone, packetized voice information, or any other suitable method for communicating speech samples to SFV server 200. SFV server 200 may analyze received speech using any suitable technique, method, or algorithm.

In a particular embodiment, SFV server 200 computes speech feature vectors for an adapted Gaussian mixture model (GMM), such as those described in the article "Speaker Verification Using Adapted Gaussian Mixture Models," by Douglas A. Reynolds, Thomas F. Quatieri, and Robert B. Dunn and "Robust Text-Independent Speaker Identification Using Gaussian Mixture Speaker Models" by Douglas A. Reynolds and Richard C. Rose. In this particular embodiment of Gaussian mixture model analysis, speech feature vectors are computed by determining the spectral energy of logarithmically-spaced filters with increasing bandwidths ("mel-filters"). The discrete cosine transform of the log-spectral energy thus obtained is known as the "mel-scale cepstrum" of the speech. The coefficients of terms in the mel-scale cepstrum, known as "feature vectors," are normalized to remove linear channel convolutional effects (additive biases) and to calculate uncertainty ranges ("delta cepstra") for the feature vectors. For example, additive biases may be removed by cepstral mean subtraction (CMS) and/or relative spectral (RASTA) processing. Delta cepstra may be calculated using techniques such as fitting a polynomial over a range of adjacent feature vectors. The resulting feature vectors characterize the sound, and may be compared to other sounds using various statistical analysis techniques.

Voice match server 300 represents any suitable hardware and/or software for comparing measured parameter sets to speaker models and determining a preferred match between the measured speech feature vectors and a speaker model. "Speaker model" refers to any mathematical quantity or set of quantities that describes a voice produced by a text-to-speech device or algorithm. Speaker models may be chosen to coincide with the type of speech feature vectors determined by SFV server 200 in order to facilitate comparison between speaker models and measured speech feature vectors, and they may be stored or, alternatively, produced in response to a particular text message, voice sample, or other source. Voice match server 300 may employ any suitable technique, method, or algorithm for comparing measured speech feature vectors to speaker models. For example, voice match server 300 may match speech characteristics using a likelihood function, such as the log-likelihood function of Gaussian mixture models or the more complex likelihood function of hidden Markov models. In a particular embodiment, voice match server 300 uses Gaussian mixture models to compare measured parameters with voice models.

Various other techniques of speech analysis may also be employed. For example, long-term averaging of acoustic features, such as spectrum representation or pitch, can reveal unique characteristics of speech by removing phonetic variations and other short-term speech effects that may make it difficult to identify the speaker. Other techniques involve comparing phonetic sounds based on similar texts to identify distinguishing characteristics of voices. Such techniques may use hidden Markov models (HMMs) to analyze the difference between similar phonemes by taking into account underlying relationships between the phonemes ("Markovian connections"). Alternative techniques may include training recognition algorithms in a neural network, so that the recognition algorithm used may vary depending on the particular speakers for which the network is trained. Network 100 may be adapted to use any of the described techniques or any other suitable technique for using measured speech feature vectors to compute a score for each of a group of candidate speaker models and determining a preferred match between the measured speech feature vectors and one of the speaker models. "Speaker models" refer to any mathematical quantities that characterize a voice associated with a particular set of TTS markup parameters and that are used in hypothesis-testing the measured speech vectors for a preferred match. For example, for Gaussian mixture models, speaker models may include the number of Gaussians in the mixture density function, the set of N probability weights, the set of N mean vectors for each of the member Gaussian densities, and the set of N covariance matrices for each of the member Gaussian densities.

TTS server 400 represents any hardware and/or software for producing voice information from text information. Voice information may be produced in any suitable output form, including analog signals, voice output from speakers, packetized voice information, or any other suitable format for communicating voice information. The acoustical characteristics of voice information created by TTS server 400 are controlled via TTS markup parameters, which may include control information for various acoustic properties of the rendered audio. Text information may be stored in any suitable file format, including email, instant messages, stored text files, or any other machine-readable form of information.

Unified messaging server 110 represents any component or components of network, including hardware and/or software, that manage different types of information for a number of users. For example, unified messaging server 100 may maintain voice messages and text messages for the users of network 102. Unified messaging server 110 may also store user profiles that include TTS markup parameters that provide the closest match to the user's voice. Unified messaging server 110 may be accessible by network connections and/or voice connections, allowing users to log in or dial in to unified messaging server 110 to retrieve messages. In a particular embodiment, unified messaging server 110 may also maintain associated profiles for users that contain information about the users that may be useful in providing messaging services to users of network 102.

In operation, a sending endpoint 108*a* communicates a text message to a receiving endpoint 108*b*. Receiving endpoint 108*b* may be set in a text-to-speech mode so that it outputs text messages as speech. In that case, components of network 100 determine a set of speech feature vectors for a voice associated with the source of a text message. The "source" of a text message may refer to endpoint 108*a* or other component that generated the message, and may also refer to the user of such a device. Thus, for example, a voice associated with the source of a text message may be the voice of a user of endpoint 108*a*. Network 100 compares the set of speech feature vectors to the speaker models to select a preferred match, which refers to a speaker model deemed to be the preferred match for the set of speech feature vectors of the voice by whatever comparison test is used. Network 100 then generates speech based on TTS markup parameters associated with the speaker model chosen as the preferred match.

In one mode of operation, components of network 100 detect that endpoint 108*b* is set to receive text messages as voice messages. Alternatively, endpoint 108*b* may communicate text messages to TTS server 400 when endpoint 108 is set to output text messages as voice messages. TTS server 400 communicates a request for a voice sample to endpoint 108*b* sending the text message. SFV server 200 receives the voice sample and analyzes the voice sample to determine speech feature vectors for the voice sample. SFV server 200 communicates the speech feature vectors to voice match server 300, which in turn compares the measured speech feature vectors to speaker models in voice match server 300. Voice match server 300 determines preferred match of the speaker models, and informs TTS server 400 of the proper TTS markup parameters associated with the preferred speaker model in order for TTS server 400 to use to generate voice. TTS server 400 then uses the selected parameter set to generate voices for text messages received from receiving endpoint 108*b* thereafter.

In another mode of operation, TTS server 400 may request a set of speech feature vectors from sending endpoint 108*a* that characterize the voice. If such compatible speech feature vectors are available, voice match server 300 can receive the speech feature vectors directly from sending endpoint 108*a*, and compare those speech feature vectors to the speaker models stored by voice match server 300. Thus, voice match server 300 exchanges information with sending endpoint 108*a* to determine the speaker model set that best matches the sampled voice.

In yet another mode of operation, voice match server 300 may use TTS server 400 to generate speaker models which are then used in hypothesis-testing the speech feature vectors of the source, as determined by SFV server 200. For example, a stored voice sample may be associated with a particular text at sending endpoint 108*a*. In that case, SFV server 200 may receive the voice sample and analyze it, while voice match server 300 receives the text message. Voice match server 300 communicates the text message to TTS server 400, and instructs TTS server 400 to generate voice data based on the text message according to an array of available TTS markup parameters. Each TTS markup parameter set corresponds to a speaker model in voice match server 300. This effectively produces many different voices from the same piece of text. SFV server 200 then analyzes the various voice samples and computes speech feature vectors for the voice samples. SFV server 200 communicates the speech feature vectors to voice match server 300, which uses the speech feature vectors for hypothesis-testing against the candidate speaker models, each of which correspond to a particular TTS markup parameter set. Because the voice samples are generated from the same text, it may be possible to achieve a greater degree of accuracy in the comparison of the voice received from endpoint 108*a* to the model voices.

The described modes of operation and techniques for determining an accurate model corresponding to an actual voice may be embodied in numerous alternative embodiments as well. In one example of an alternative embodiment, endpoints 108 in a distributed communication architecture include functionality sufficient to perform any or all of the described tasks of servers 200, 300, and 400. Thus, an endpoint 108 set to output text information as voice information could perform the described steps of obtaining a voice sample, determining a matching TTS markup parameter set for TTS generation, and producing speech output using the selected parameter set. In such an embodiment, endpoints 108 may also analyze the voice of their respective users and maintain speech feature vector sets that can be communicated to compatible voice recognition systems.

In another alternative embodiment, the described techniques may be used in a unified messaging system. In this case, servers 200, 300, and 400 may exchange information with a unified messaging server 110. For example, unified messaging server 110 may maintain voice samples as part of a profile for particular users. In this case, SFV server 200 and voice match server 300 may use stored samples and/or parameters for each user to determine an accurate match for the user. These operations may be performed locally in network 102 or in cooperation with a remote network using a unified messaging server 110. Thus, the techniques may be adapted to a wide array of messaging systems.

In other alternative embodiments, the functionality of SFV server 200, voice match server 300, and TTS server 400 may be integrated or distributed among components. For example, network 102 may include a hybrid server that performs any or all of the described voice analysis and model selection tasks. In another example, TTS server 400 may represent a collection of separate servers that each generate speech according to a particular TTS markup parameter set. Consequently, voice match server 300 may select a particular server 400 associated with the selected TTS markup parameter set, rather than communicating a particular parameter set to TTS server 400.

One technical advantage of certain embodiments of the present invention is increased utility for users of endpoints of 108. The use of voices similar to the person providing the text message provides increased ability for the user of a particular endpoint 108 to recognize a source using secondary queues. In general, this feature may also make it easier for users in general to interact with TTS systems in network 100.

Another technical advantage of certain embodiments is interoperability with other systems. Since endpoints 108 are already equipped to exchange voice information, there is no additional hardware, software, or shared protocol required for endpoints 108 to provide voice samples for SFV server 200 or voice match server 300. Consequently, the described techniques may be incorporated in existing systems and work in conjunction with systems that do not use the same techniques for speech analysis and reproduction.

Figure 2:
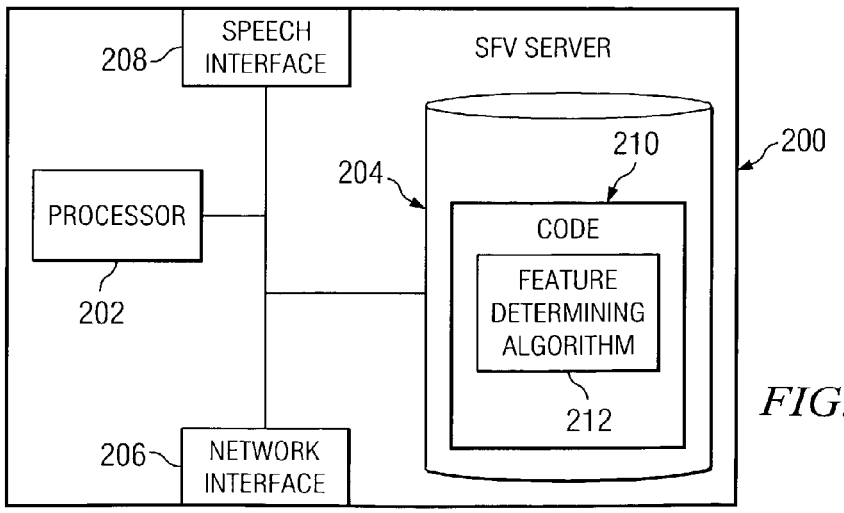
FIG. 2 illustrates a speech feature vector server in the network of FIG. 1.

FIG. 2 illustrates a particular embodiment of SFV server 200. In the depicted embodiment, SFV server 200 includes a processor 202, a memory 204, a network interface 206, and a speech interface 208. In general SFV server 200 performs analysis on voices received by SFV server 200 and produces mathematical quantities (feature vectors) that describe the audio characteristics of the voices received.

Processor 202 represents any hardware and/or software for processing information. Processor 202 may include microprocessors, microcontrollers, digital signal processors (DSPs), or any other suitable hardware and/or software component. Processor 202 executes code 210 stored in memory 204 to perform various tasks of SFV server 200.

Memory 204 represents any form of information storage, whether volatile or non-volatile. Memory 204 may include optical media, magnetic media, local media, remote media, removable media, or any other suitable form of information storage. Memory 204 stores code 210 executed by processor 202. In the depicted embodiment, code 210 includes a feature-determining algorithm 212. Algorithm 212 represents any suitable technique or method for characterizing voice information mathematically. In a particular embodiment, feature-determining algorithm 212 analyzes speech and computes a set of feature vectors used in Gaussian mixture models for speech comparison.

Interfaces 206 and 208 represent any ports or connections, whether real or virtual, allowing SFV server 200 to exchange information with other components of network 100. Network interface 206 is used to exchange information with components of data network 102, including voice match server 300 and/or TTS server 400 as described in modes of operation above. Speech interface 208 allows SFV server 200 to receive speech, whether through a microphone, in analog form, in packet form, or in any other suitable method of voice communication. Speech interface 208 may allow SFV server 200 to exchange information with endpoints 108, unified messaging server 110, TTS server 400, or any other component which may use the speech analysis capabilities of SFV server 200.

In operation, SFV server 200 receives speech data at speech interface 208. Processor 202 executes feature-determining algorithm 212 to determine speech feature vectors characterizing speech. SFV server 200 communicates the speech feature vectors to other components of network 100 using network interface 206.

Figure 3:
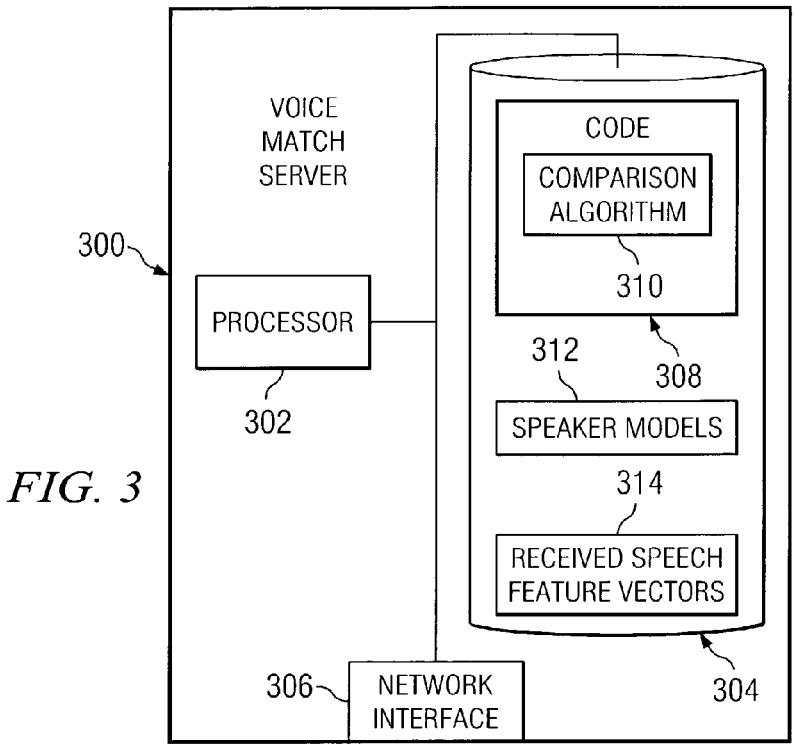
FIG. 3 illustrates a voice match server in the network of FIG. 1.

FIG. 3 shows an example of one embodiment of voice match server 300. In the depicted embodiment, voice match server 300 includes a processor 302, a memory 304, and a network interface 306, which are analogous to the similar components of SFV server 200 described above and may include any of the hardware and/or software components described in conjunction with the similar components in FIG. 2. Memory 304 of voice match server 300 stores code 308, speaker models 312, and receives speech feature vectors 314.

Code 308 represents instructions executed by processor 302 to perform tasks of voice match server 300. Code 308 includes comparison algorithm 310. Processor 302 uses comparison algorithm 310 to compare a set of speech feature vectors to a collection of speaker models to determine the preferred match between the speech feature vector set under consideration and one of the models. Comparison algorithm 310 may be a hypothesis-testing algorithm, in which a proposed match is given a probability of matching the set of speech feature vectors under consideration, but may also include any other suitable type of comparison. Speaker models 312 may be a collection of known parameters sets based on previous training with available voices generated by TTS server 400. Alternatively, speaker models 312 may be generated as needed on a case-by-case basis as particular text messages from a source endpoint 108 need to be converted into speech. Received speech feature vectors 314 represent parameters characterizing a voice sample associated with a source endpoint 108 from which text is to be converted to speech. Received speech feature vectors 314 are generally the results of the analysis performed by SFV server 200, as described above.

In operation, voice match server 300 receives speech feature vectors characterizing a voice associated with endpoint 108 from SFV server 200 using network interface 306. Processor 302 stores the parameters in memory 304, and executes comparison algorithm 310 to determine a preferred match between received speech feature vectors 314 and speaker models 312. Processor 302 determines the preferred match from the speaker models 312 and communicates the associated TTS markup parameters to TTS server 400 to be used in generation of subsequent speech from text messages received from the particular endpoint 108. Alternative modes of operation are also possible. For example, voice match server 300 may generate speaker models 312 after the received speech feature vectors 314 are received from SFV server 200 rather than maintaining stored speaker models 312. This may provide additional versatility and/or accuracy in determining the preferred match in speaker models 312.

Figure 4:
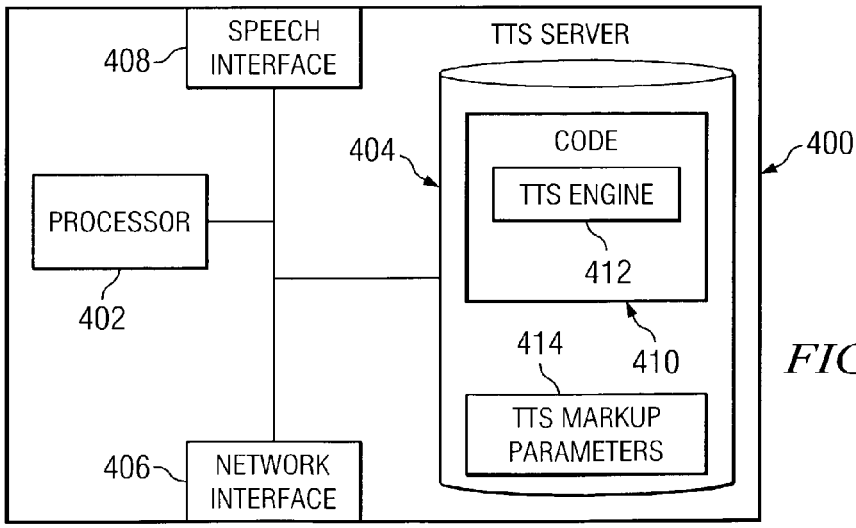
FIG. 4 illustrates a text-to-speech server in the network of FIG. 1.

FIG. 4 shows a particular embodiment of TTS server 400. In the depicted embodiment, TTS server 400 includes a processor 402, a memory 404, a network interface 406, and a speech interface 408, which are analogous to the similar components of SFV server 200 described in conjunction with FIG. 2 and may include any of the hardware and/or software components described there. In general, TTS server 400 receives text information and generates voice information from the text using TTS engine 412.

Memory 404 of TTS server 400 stores code 410 and stored TTS markup parameters 414. Code 410 represents instructions executed by processor 402 to perform various tasks of TTS server 400. Code 410 includes a TTS engine 412, which represents the technique, method, or algorithm used to produce speech from voice data. The particular TTS engine 412 used may depend on the available input format as well as the desired output format for the voice information. TTS engine 412 may be adaptable to multiple text formats and voice output formats. TTS markup parameters 414 represent sets of parameters used by TTS engine 412 to generate speech. Depending on the set of TTS markup parameters 414 selected, TTS engine 412 may produce voices with different sound characteristics.

In operation, TTS server 400 generates speech based on text messages received using network interface 406. This speech is communicated to endpoints 108 or other destinations using speech interface 408. To generate speech for a particular text message, TTS server 400 is provides with a particular set of TTS markup parameters 414, and generates the speech using TTS engine 412 accordingly. In cases where TTS server 400 does not have a particular voice to associate with the message, TTS server 400 may use a default set of TTS markup parameters 414 corresponding to a default voice. When source-dependent information is available, TTS server 400 may receive the proper TTS markup parameter selection from voice match server 300, so that the TTS markup parameters correspond to a preferred speaker model. This may allow TTS engine 400 to produce a more accurate reproduction of the voice of the person that sent the text message.

Figure 5:
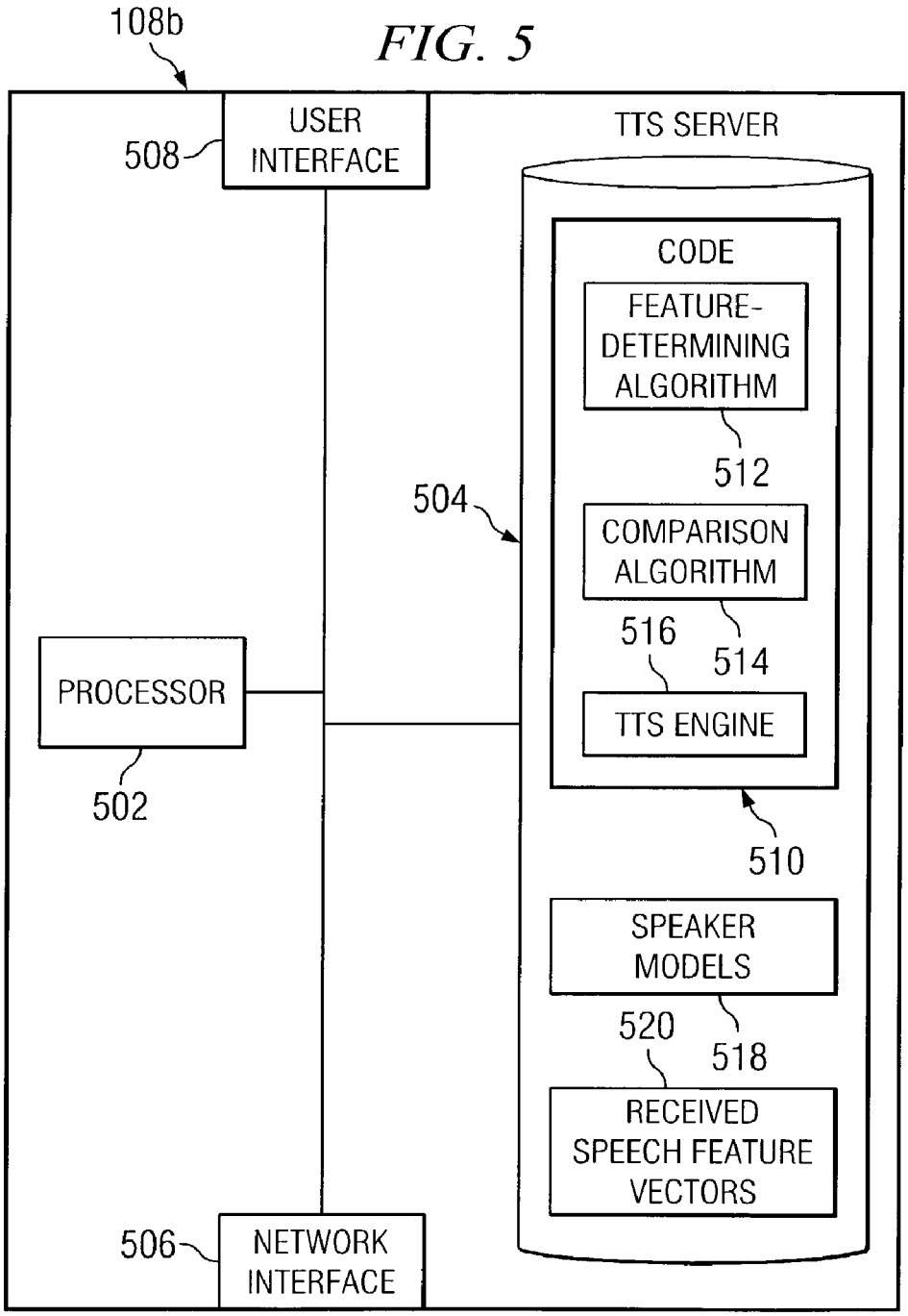
FIG. 5 illustrates an endpoint, according to a particular embodiment of the invention, that provides source-dependent text-to-speech.

FIG. 5 illustrates a particular embodiment of endpoint 108*b*. In the depicted embodiment, endpoint 108*b* includes a processor 502, a memory 504, a network interface 506, and a user interface 508. Processor 502, memory 504, and network interface 506 correspond to similar components of SFV server 200, voice match server 300, and text-to-speech server 400 described previously, and may include any similar hardware and/or software components as described previously for those components. User interface 108 represents any hardware and/or software by which endpoint 108*b* exchanges information with a user. For example, user interface 108 may include microphones, keyboards, keypads, displays, speakers, mice, graphical user interfaces, buttons, or any other suitable form of information exchange.

Memory 504 of endpoint 108*b* stores code 512, speaker models 518, and received speech feature vectors 520. Code 512 represents instructions executed by processor 502 to perform various tasks of endpoint 108*b*. In a particular embodiment, code 512 includes a feature-determining algorithm 512, a comparison algorithm 514, and a TTS engine 516. Algorithms 512 and 514 and engine 516 correspond to the similar algorithms described in conjunction with SFV server 200, voice match server 300, and TTS server 400, respectively. Thus, endpoint 108*b* integrates the functionality of those components into a single device.

In operation, endpoint 108 exchanges voice and/or text information with other endpoints 108 and/or components of network 100 using network interface 506. During the exchange of voice information with other devices, endpoint 108*b* may determine speech feature vectors 520 for received speech using feature-determining algorithm 512 and store those feature vectors 520 in memory 504, associating parameters 520 with sending endpoint 108*a*. The user of endpoint 108*b* may trigger a text-to-speech mode of endpoint 108*b*. In text-to-speech mode, endpoint 108*b* generates speech from received text messages using TTS engine 516. Endpoint 108*b* selects a speaker model set 518 for speech generation based on the source of the text message by comparing parameters 520 to speaker models 518 using comparison algorithm 514, and uses TTS markup parameters associated with the preferred model to generate speech. Thus, the speech produced by TTS engine 516 closely corresponds to the source of the text message.

In alternative embodiments, endpoint 108*b* may perform different or additional functions. For example, endpoint 108*b* may analyze the speech of its own user using feature-determining algorithm 512. This information may be exchanged with other endpoints 108 and/or compared with speaker models 518 to provide a cooperative method for source-dependent text-to-speech. Similarly, endpoints 108 may cooperatively negotiate a set of speaker models 518 for use to text-to-speech operation, allowing a distributed network architecture to determine a suitable protocol to allow source-dependent text-to-speech. In general, the description of endpoints 108 may also be adapted in any manner consistent with any of the embodiments of network 100 described anywhere previously.

Figure 6:
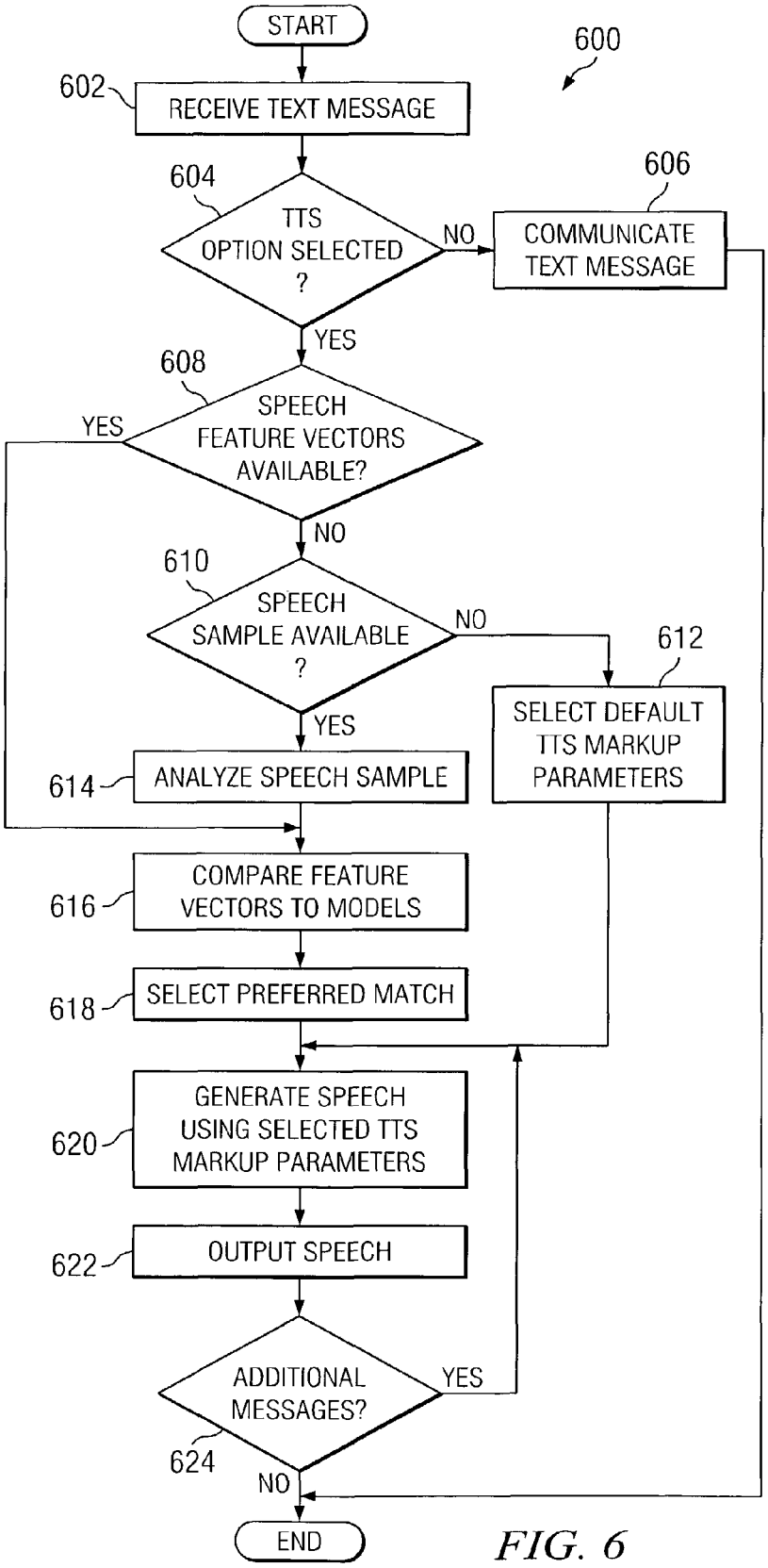
FIG. 6 is a flow chart illustrating one example of a method of operation for the network of FIG. 1.

FIG. 6 is a flowchart 600 illustrating one method of selecting a proper set of TTS markup parameters to produce source-dependent speech output in network 100. Endpoint 108 receives a text message at step 602. If endpoint 108 has a setting enabled that converts text to voice, message may be received by endpoint 108 and communicated to other components of network 100, or alternatively, may be received by TTS engine 400 or another component. At decision step 604, it is determined whether the endpoint 108 has the TTS option selected. If endpoint 108 does not have TTS option selected, the message is communicated to the endpoint in text form at step 606. If the TTS option has been selected, TTS engine 400 determines whether speech feature vectors are available at step 608. This may be the case if a previous determination for speech feature vectors has been made for the endpoint 108 sending the message, or if endpoint 108 uses a compatible voice characterization system that maintains speech feature vectors for the user of endpoint 108. If speech feature vectors are not available, TTS engine 400 next determines if a speech sample is available at decision step 610. If neither speech feature vectors nor a speech sample is available TTS engine 400 uses default TTS markup parameters to characterize the speech at step 612.

If a speech sample is available, then SFV server 200 analyzes the speech sample at step 614 to determine speech feature vectors for the voice sample. Once feature vectors are either received from endpoint 108 or determined by SFV server 200, voice match server 300 compares the feature vectors to speaker models at step 616 and determines a preferred match from those parameters at step 618.

After the preferred match for speech feature vectors is selected or a default set of TTS markup parameters is used, TTS engine 400 generates speech using the associated TTS markup parameters at step 620. TTS engine 400 outputs the speech using speech interface 408 at step 622. TTS engine 400 then determines whether there are additional text messages to be converted at decision step 624. As part of this step 624, TTS engine 400 may verify whether endpoint 108 is still set to output text messages in voice form. If there are additional text messages from the endpoint 108 (or if endpoint 108 is no longer set to output text messages in voice form), TTS engine 400 uses the previously-selected parameters to generate speech from the subsequent text messages. Otherwise, the method is at an end.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A method of generating speech from text messages, comprising:

determining a speech feature vector for a voice associated with a source of a first text message;

comparing the speech feature vector to a plurality of speaker models, wherein the plurality of speaker models are unrelated to the source of the first text message;

based on the comparison, selecting one of the speaker models as a preferred match for the voice;

associating the selected speaker model with the source of the first text message;

if the speech feature vector cannot be determined, selecting one of the speaker models as a default selection;

generating speech from the text message based on the selected speaker model; and automatically generating speech from subsequent text messages received from the source of the first text message, based on the selected speaker model.

2. The method of claim 1, wherein the step of determining comprises:

receiving a sample of the voice; and analyzing the sample to determine the speech feature vector for the voice.

3. The method of claim 1, wherein the step of determining comprises:

requesting an endpoint that is the source of the text message to provide the speech feature vector; and receiving the speech feature vector from the endpoint.

4. The method of claim 1, wherein the step of generating comprises communicating a command to generate the speech to a text-to-speech server, the command comprising the selected speaker model, wherein the text-to-speech server generates the speech based on the selected speaker model.

5. The method of claim 1, wherein:

the speech feature vector comprises a feature vectors for a Gaussian mixture model; and the step of comparing comprises comparing a first Gaussian mixture model associated with the speech feature vector with a plurality of second Gaussian mixture models, each second Gaussian mixture model associated with at least one of the speaker models.

6. The method of claim 1, further comprising:

generating a plurality of model voice samples; and analyzing the model voice samples to determine the speaker model for each model voice sample.

7. The method of claim 6, wherein the model voice samples are generated based on a text sample associated with the voice sample.

8. The method of claim 1, wherein the steps of the method are implemented by an endpoint in a communication network.

9. The method of claim 1, wherein the steps of the method are implemented in a voice match server in a communication network.

10. The method of claim 1, wherein:

the steps of the method are implemented in a unified messaging system; and the speech feature vector is associated with a user that provided the text message in a user profile.

11. A voice match server, comprising:

an interface operable to:

receive a speech feature vector for a voice associated with a source of a first text message; and communicate a command to a text-to-speech server instructing the text-to-speech server to generate speech from the text message based on a selected speaker model; and a processor operable to:

compare the speech feature vector to a plurality of speaker models, wherein the plurality of speaker models are unrelated to the source of the text message;

select one of the speaker models as a preferred match for the voice based on the comparison;

associate the selected speaker model with the source of the first text message; and select one of the speaker models as a default selection if the interface does not receive the speech feature vector; and the interface further operable to communicate a command to a text-to-speech server instructing the text-to-speech server to automatically generate speech from subsequent text messages received from the source of the first text message, based on the selected speaker model.

12. The server of claim 11, further comprising a memory operable to store the plurality of speaker models.

13. The server of claim 11, wherein:

the interface is further operable to cause the text-to-speech server to generate a plurality of model voice samples; and the speaker models are determined based on analysis of the model voice samples.

14. The server of claim 13, wherein the model voice samples are generated based on a text sample associated with the voice sample.

15. The server of claim 11, wherein:

the interface is further operable to communicate a request for the speech feature vector to an endpoint that is the source of the text message; and the interface receives the speech feature vector from the endpoint.

16. The server of claim 11, wherein:

the speech feature vector comprises a feature vector for a Gaussian mixture model; and the step of comparing comprises comparing a first Gaussian mixture model associated with the speech feature vector to a plurality of second Gaussian mixture models, each second Gaussian mixture model associated with at least one of the speaker models.

17. The server of claim 11, wherein:

the server is part of a unified messaging system; and the speech feature vector is associated with a user that provided the text message in a user profile.

18. An endpoint, comprising:

a first interface operable to receive a first text message from a source; and a processor operable to:

determine a speech feature vector for a voice associated with a source of the text message;

compare the speech feature vector to a plurality of speaker models, wherein the plurality of speaker models are unrelated to the source of the first text message;

select one of the speaker models as a preferred match for the voice based on the comparison;

associate the selected speaker model with the source of the first text message;

select one of the speaker models as a default selection if the processor cannot determine the speech feature vector;

generate speech from the text message based on the selected speaker model; and automatically generate speech from subsequent text message received from the source of the first text message, based on the selected speaker model; and a second interface operable to output the generated speech to a user.

19. The endpoint of claim 18, wherein the first interface is further operable to:

communicate a request for the speech feature vector to the source of the text message; and receive the speech feature vector in response to the request.

20. The endpoint of claim 18, wherein:

the first interface is further operable to receive a voice sample from the source of the text message; and the processor is further operable to analyze the voice sample to determine the speech feature vector.

21. The endpoint of claim 18, wherein:

the first interface is further operable to receive speech from the source of the text message;

the second interface is further operable to output the received speech; and the processor is further operable to analyze the received speech to determine the speech feature vector.

22. A system, comprising:

a voice match server operable to:

compare a speech feature vector, for a voice associated with a source of a first text message, to a plurality of speaker models, wherein the plurality of speaker models are unrelated to the source of the first text message; and select one of the speaker models as a preferred match for the voice based on the comparison;

associate the selected speaker model with the source of the first text message;

select one of the speaker models as a default selection if the speech feature vector cannot be determined; and a text-to-speech server operable to generate speech from the text message based on the selected speaker model; and the text-to-speech server further operable to automatically generate speech from subsequent text messages received from the source of the first text message, based on the selected speaker model.

23. The system of claim 22, further comprising a speech feature vector server operable to:

receive speech; and determine an associated speech feature vector based on the speech, wherein the speech feature vector compared by the voice match server is received from the speech feature vector server.

24. The system of claim 22, wherein the voice match server is further operable to receive the speaker models from the speech feature vector server.

25. The system of claim 24, wherein:

the voice match server is further operable to cause the text-to-speech server to generate a plurality of model voice samples; and the speech feature vector server is further operable to analyze the voice samples to determine the speaker models.

26. The system of claim 22, wherein:

the text-to-speech server is one of a plurality of text-to-speech servers, each text-to-speech server operable to generate speech using a different speaker model; and the voice match server is further operable to select one of the text-to-speech servers to generate speech based on which text-to-speech server uses the selected speaker model.

27. Software embodied in a non-transitory tangible computer-readable medium, operable to perform the steps of:

determining a speech feature vector for a voice associated with a source of a first text message;

comparing the speech feature vector to a plurality of speaker models, wherein the plurality of speaker models are unrelated to the source of the first text message;

based on the comparison, selecting one of the speaker models as a preferred match for the voice;

associating the selected speaker model with the source of the first text message;

selecting one of the speaker models as a default selection if the speech feature vector cannot be determined;

generating speech from the text message based on the selected speaker model; and automatically generating speech from subsequent text messages received from the source of the first text message, based on the selected speaker model.

28. The software of claim 27, wherein the step of determining comprises:

receiving a sample of the voice; and analyzing the sample to determine the speech feature vector for the voice.

29. The software of claim 27, wherein the step of determining comprises:

requesting an endpoint that is the source of the text message to provide the speech feature vector; and receiving the speech feature vector from the endpoint.

30. The software of claim 27, further operable to perform the steps of:

generating a plurality of model voice samples; and analyzing the model voice samples to determine the speaker model for each model voice sample.

31. A system, comprising:

means for determining a speech feature vector for a voice associated with a source of a first text message;

means for comparing the speech feature vector to a plurality of speaker models, wherein the plurality of speaker models are unrelated to the source of the first text message;

means for selecting one of the speaker models as a preferred match for the voice based on the comparison;

means for associating the selected speaker model with the source of the first text message;

means for selecting one of the speaker models as a default selection if the speech feature vector cannot be determined;

means for generating speech from the text message based on the selected speaker model; and means for automatically generating speech from subsequent text messages received from the source of the first text message, based on the selected speaker model.

32. The system of claim 31, wherein the means for determining comprise:

means for receiving a sample of the voice; and means for analyzing the sample to determine the speech feature vector for the voice.

33. The system of claim 31, wherein the means for determining comprise:

means for requesting an endpoint that is the source of the text message to provide the speech feature vector; and means for receiving the speech feature vector from the endpoint.

34. The system of claim 31, further comprising:

means for generating a plurality of model voice samples; and means for analyzing the model voice samples to determine the speaker model for each model voice sample.

* * * * *